US006581823B1

(12) United States Patent
De Beck

(10) Patent No.: US 6,581,823 B1
(45) Date of Patent: Jun. 24, 2003

(54) PASTRY TOTE WITH HANDLES

(76) Inventor: Thom De Beck, 128 First Ave., New York, NY (US) 10009

( * ) Notice: Subject to any disclaimer, the term of this patent is extended or adjusted under 35 U.S.C. 154(b) by 0 days.

(21) Appl. No.: 10/057,992

(22) Filed: Jan. 29, 2002

(51) Int. Cl.[7] ..... B65D 5/30; B65D 5/46
(52) U.S. Cl. ..... 229/117.14; 229/117.15
(58) Field of Search ..... 229/117.14, 117.15, 229/122, 161, 200, 230

(56) References Cited

U.S. PATENT DOCUMENTS

| | | | | | |
|---|---|---|---|---|---|
| 1,135,742 | A | | 4/1915 | Voris | |
| 2,008,443 | A | * | 7/1935 | Froehlig | 229/117.14 |
| 2,041,021 | A | * | 5/1936 | Quagliotti | 229/117.15 |
| 2,074,638 | A | | 3/1937 | Black | |
| 2,160,551 | A | * | 5/1939 | Lupton | 229/117.15 |
| 2,323,782 | A | | 7/1943 | Kretchmer | |
| 2,351,207 | A | | 6/1944 | Henderon et al. | |
| 2,355,729 | A | * | 8/1944 | Inman | 229/117.14 |
| 2,508,909 | A | | 5/1950 | Evans et al. | |
| 2,548,252 | A | | 4/1951 | Bergstein | |
| 2,685,402 | A | * | 8/1954 | Caster | 229/117.14 |
| 2,805,019 | A | | 9/1957 | Muhs et al. | |
| 2,805,813 | A | | 9/1957 | Rittmueller | |
| 3,105,627 | A | * | 10/1963 | Bowdoin | 229/117.14 |
| 3,377,015 | A | | 4/1968 | Moreno | |
| 4,184,595 | A | * | 1/1980 | Wackerman | 229/117.14 |
| 5,042,715 | A | | 8/1991 | McNeill | |
| 5,275,331 | A | * | 1/1994 | Chung-Piao | 229/117.15 |
| 5,957,276 | A | * | 9/1999 | Cutler et al. | 229/117.14 |
| 6,036,085 | A | * | 3/2000 | Tsao | 229/117.14 |
| 6,062,466 | A | | 5/2000 | Itey | |

* cited by examiner

*Primary Examiner*—Gary E. Elkins
(74) *Attorney, Agent, or Firm*—C. J. Husar, Esq.

(57) ABSTRACT

The present invention relates to a readily assembled pastry box that includes a pair of panels extending from opposite sides to form a pair of convenient carrying handles with a finger engaging slot therein, thus eliminating the need for string tying. The box is provided in blank form of conventional card stock and includes appropriate cuts and fold lines for convenient storage and easy assembly. It further includes multiple abutting side portions that interlock with latches to provide reinforcement and stability to protect the contents therein. Although referred to as a pastry box, it finds utility in carrying many other items as well. The unique handles allow for carrying its contents in a horizontal position without fear of damage during transit. The fold lines are optionally provided with slight indentations or perforations over portions thereof to facilitate the folding when assembling the box.

6 Claims, 3 Drawing Sheets

PASTRY TOTE WITH HANDLES

This application was originally filed on Feb. 8, 2001, in the United States Patent and Trademark Office under the Disclosure Document Deposit Program and was assigned Disclosure Document No. 488321.

BACKGROUND OF THE INVENTION

The invention relates generally to a box or carton for carrying various types of products. More specifically, it relates to a box which is provided in flat blank form and is readily assembled and includes a cover, bottom and four sides that interlock and a pair of panel members which extend upwardly from opposite sides to form a handle for carrying the product therein in a stable horizontal position.

We have all experienced the situation of visiting a bakery and making purchases such as a pie, cake, cookies, or other pastries and the products are placed in a box followed by several wraps of string in each direction to form an attachment for carrying the goodies. Although this procedure has served its purpose over the years, there are many disadvantages, such as, arriving at home and finding that the cookies are crushed or the box has collapsed and damaged the contents. Additionally, there is always that uncomfortable string pressure on the fingers while carrying and the vexing routine of trying to untie the knots in preparation for eating. Thus, there remains a need for a box which can be readily assembled in less time than conventional boxes and also provide a convenient, stable, carrying handle which, when opened at the destination for use, provides ready access to the lid/cover and the contents therein.

DESCRIPTION OF THE PRIOR ART

A manual search of the U.S. Patent Office files was conducted in the appropriate class and subclasses revealed the following patents.

| | | | |
|---|---|---|---|
| 1,135,742 | 2,351,207 | 2,548,252 | 3,377,015 |
| 2,074,638 | 2,508,909 | 2,805,019 | 6,062,466 |

The above cited patents, although they all disclose some type of handle structure, can be divided into two groups. The first group includes Bergstein, '252; Henderson et al, '207 and Muhs et al '019, each of which are disclosed as luggage-type carrying cases that include attached carrying handles that are located at one end of the box and are of totally different construction from that of the subject invention and do not provide for the carrying of the contents in a horizontal position. Bergstein, '252 is disclosed as a clothing box which includes handles that are separate from the box blank and are adhesively attached thereto.

The remaining five patents are all disclosed as pastry or cake-type boxes with integral carrying handles. Voris, '742 discloses a folding paper box wherein the cover/lid is formed of two top pieces 4, 5 with extending handle portions 11, 15. Black, '638 also discloses a box having a pair of top members 3 with handle portions extending there from. Evans et al, '909 discloses a receptacle for bakery products which includes a top 22, bottom 12, sides 14, 15, 16, 17 and a pair of flaps 28, 29 with cut-out portions 59 and 60 for receiving a separate latching handle 36. Moreno, '015 discloses a six sided box with finger-receiving apertures 34 and is used for holding cakes. Itey, '468 discloses a folding box for products such as pastries and cakes. The box includes a bottom and four sides which interlock at the top to form finger holes 01, 02.

As can be seen from the above cited art, there have been many attempts to provide an easily assembled box that includes carrying handles. However, there has never been provided a box with integral handles that are separate from lid/cover that are readily released to provide ready access to the lid and contents therein. The structure of applicant's box provides handles portions that extend upwardly from a pair of panels that extend the full width of the box, thus providing support along both sides thereof.

SUMMARY OF THE INVENTION

The present invention provides a box which can be used for many purposes in addition to that set forth above with regard to pastry products. However, it does find particular usefulness by bakeries and pastry shops to package their cakes, pies, cookies and donuts. The box includes a plurality of interlocking sides, bottom, top and a pair of upwardly extending panel portions with finger cut-out flaps for convenient carrying. The boxes can be shipped and easily stored in a flat blank condition and readily assembled prior to use. It allows speedy packaging, reduced costs and provides the customer with ease of handling.

OBJECTS OF THE INVENTION

An object of the invention is to provide a box that is readily stored in blank condition and easily assembled for use.

A further object of the invention is to provide a pastry box that has convenient handles for carrying.

Yet another object of the invention is to provide a box that can be conveniently shipped and stored in a flat blank condition prior to use, taking up a minimum amount of precious storage space.

Still another object of the invention is to provide a pastry container that is sturdy and provides protection for the items inside.

A still further object of the invention is to provide a box that includes a plurality of latching flap portions that are reinforced by inwardly folded flaps of the cover.

Another object of the invention is to provide a box having fold/crease lines with partial perforations therein for ease of folding during assembly.

These and other objects of the invention will becme more apparent hereinafter. The instant invention will now be described with particular reference to the accompanying drawings which form a part of this specification wherein like reference characters designate the corresponding parts in the several views.

DETAILED DESCRIPTION OF THE DRAWINGS

Figure 1:
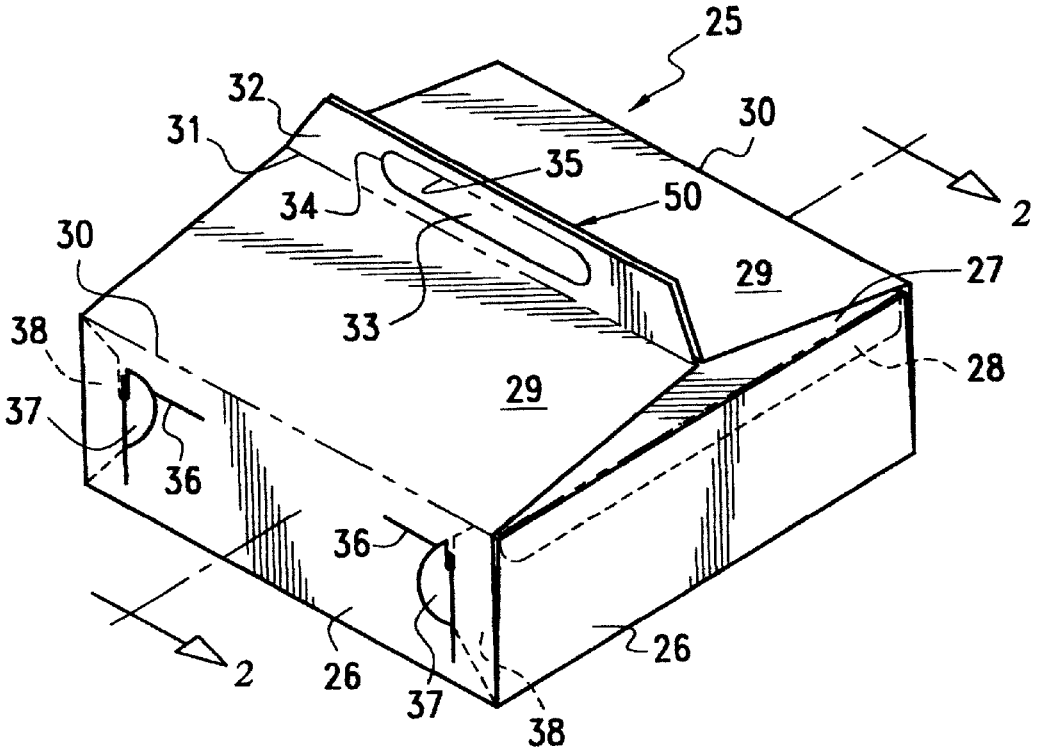
FIG. 1 is a perspective view, showing the pastry box in its assembled condition.

Referring to FIG. 1, there is shown a perspective view of the pastry box 5 in its assembled condition. As illustrated, box 25 includes four sides 26, (only two shown in this view) with the lid 27 and extending flap 28 turned downward inside box 25 abutting side 26. Two opposite sides 26 include panel extensions 29 that project upwardly at an acute angle from crease lines 30, followed by crease line 31 and a vertical portion 32 that includes a transverse finger opening 33 that is formed by a cut-out 34 and crease line 35 permitting insertion of a plurality of fingers through handle 50 for convenient carrying, Side 26 is shown with a pair of spaced right-angle slits 36 which serve to hold latches 37 formed on latch flaps 38 and securely hold all four sides 26 in place. Opposite side 26 also includes a pair of right-angle slits 36 to accommodate latches 37 on that side to lock sides 26 and rigidify the box.

Figure 2:
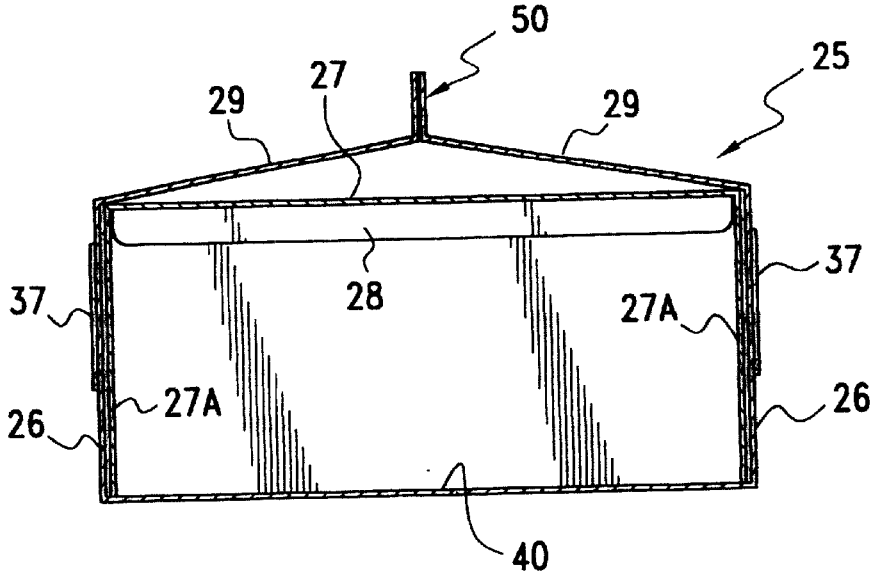
FIG. 2 is a sectional view, taken along the plane 2—2 of FIG. 1, illustrating the interior thereof.

Turning now to FIG. 2, there is illustrated a sectional view taken along the plane 2—2 of FIG. 1. As illustrated, lid 27 includes a pair of side flaps 27A which extend the full length and height of sides 26 to provide complete lateral support to box 25. Further, flaps 38 extend for a short lateral distance in the corner areas along sides 26 and provide additional structural strength to the box 25 with latch members 37 interlocking with slits 36. Thus two sides 26 of box 25 have three layers of support, i.e. top flaps 27A, latch flaps 38 and sides 26, all of which contribute to a unique, easily assembled pastry box or any other type of useful box.

Figure 3:
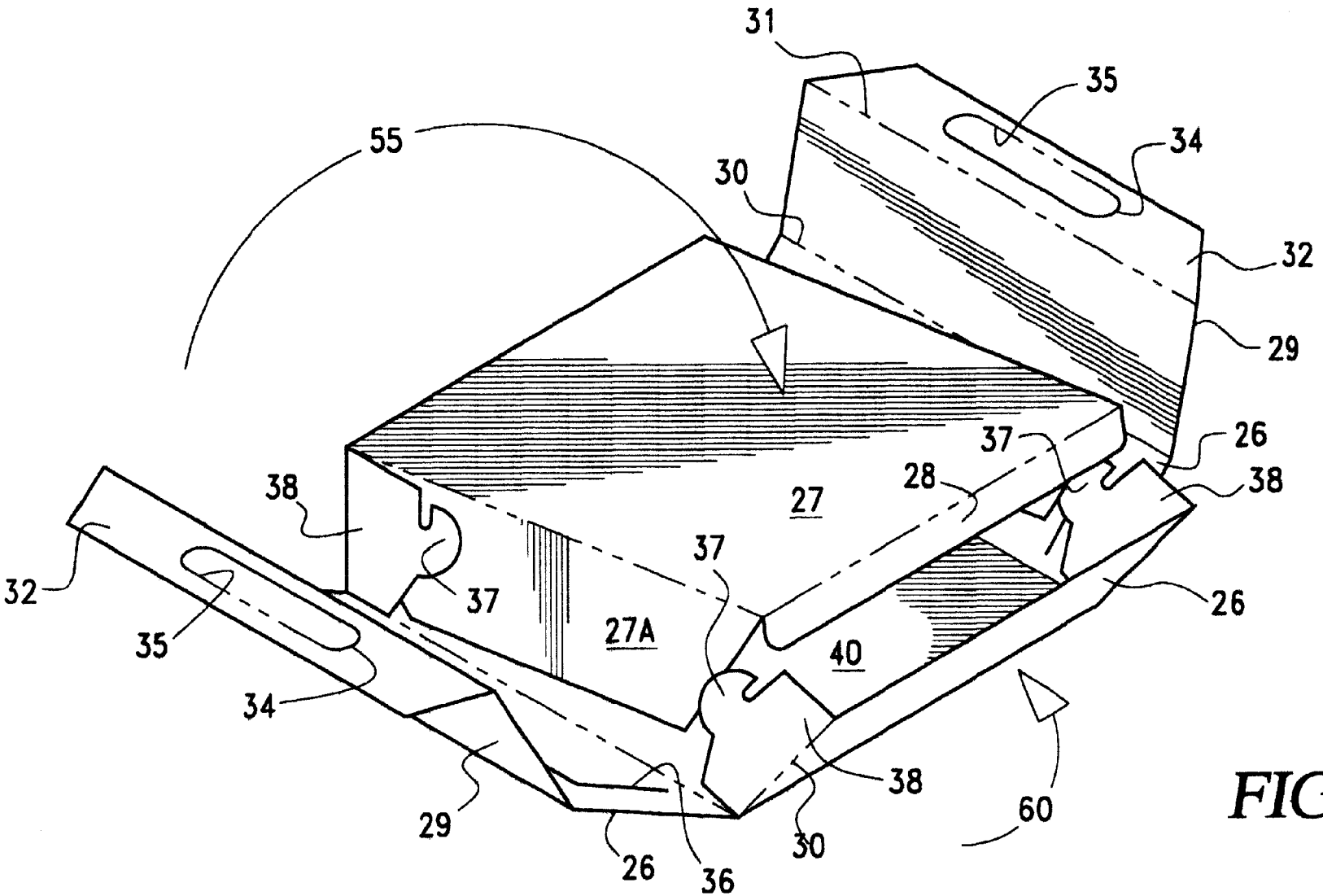
FIG. 3 is a perspective view of a partial folded box showing the seqence of folding.

Referring to FIG. 3, there is shown box 25, in its partially assembled state. As shown, lid 27 is folded downwardly along fold line 30 with lid flap 28 also shown folded downwardly as indicated by arrow 55 with side 26 folded upwardly as indicated by arrow 60. The next step in the assembly process would be to engage latches 37 into their respective slits 36, raise lid 27 and insert the product to be carried, followed by closing of the lid 27 and bringing both vertical portions 32 together and completing the assembly of the box and carrying handle 50.

Figure 4:
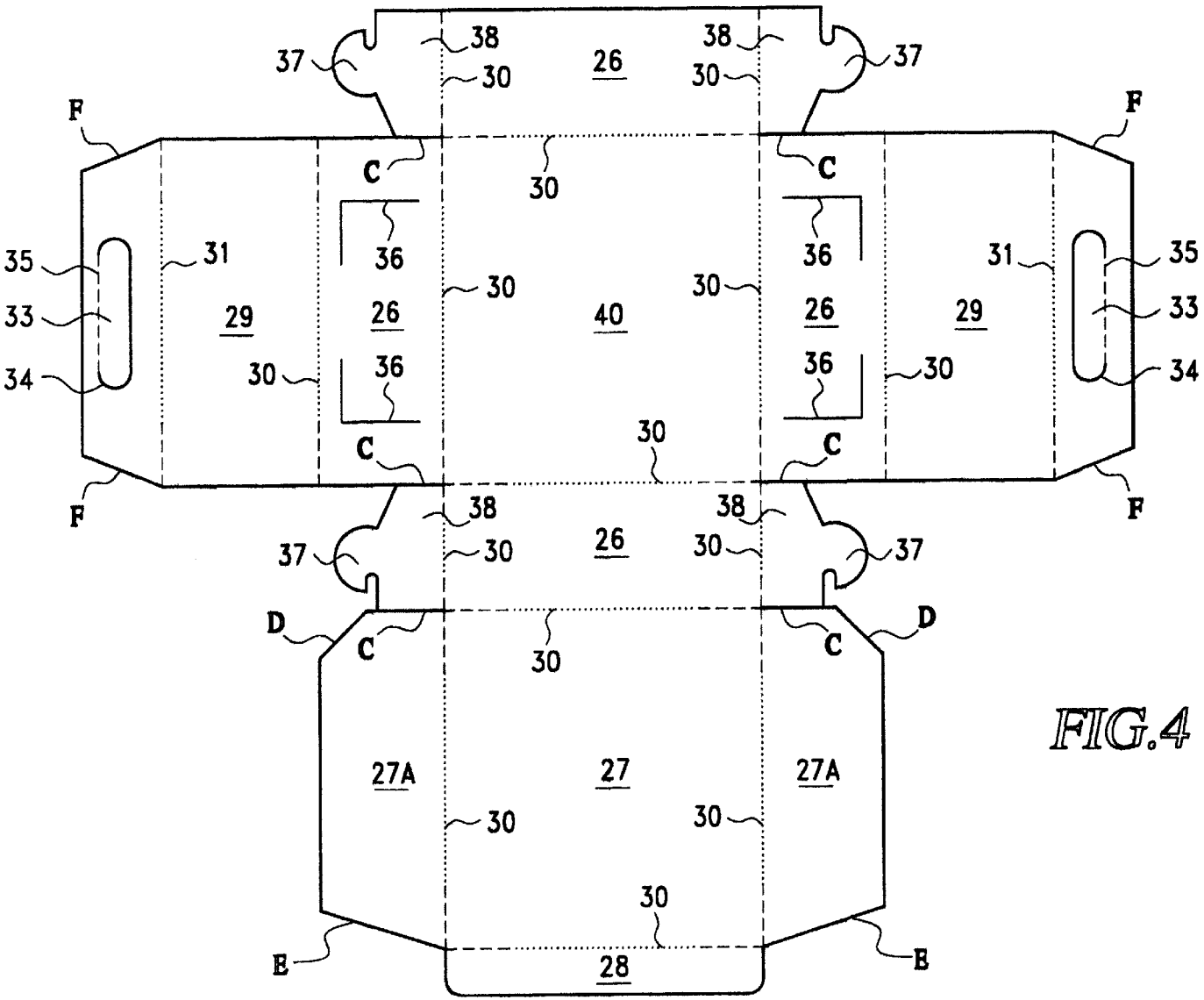
FIG. 4 is a plan view of a box blank illustrating the various cut and fold lines utilized.

Turning now to FIG. 4, there is illustrated a plan view of the blank utilized in forming box 25. As shown, the blank is stamped out or cut into the shape shown from conventional card stock material used for boxes of this type. Bottom panel 40 is shown with four fold lines 30 about its perimeter thereof. Extending from an opposite pair of said fold lines 30 are a first pair of sides 26, the height of which is set by the location of a second pair of fold lines 30 parallel to and spaced from said first set of fold lines 30. The first pair of sides 26 are provided with a plurality of spaced slits 36 for receiving latches 37 of latch flaps 38. Spaced from the second set of fold lines 30 is a third set of fold lines 31 which form handle panels 29 there between followed by a finger receiving portion 33. Extending from one of the two remaining bottom panel 40 fold lines 30 is a third side 26 that includes fold line 30 and cuts C to allow latch flaps 38 to fold and form the corners of box 25. Latch flaps 38 further include latches 37 formed on the outer ends thereof for engaging slits 36 and securely hold the sides 26 together. Extending from the last fold line 30 of bottom panel 40 is the fourth side 26 formed by a further fold line 30, parallel to and spaced from the bottom panel 40 fold line 30. A pair of integral latch flaps 38 are formed by fold lines 30 and cuts C and include a second pair of latches 37 on the outer ends thereof for engaging the remaining pair of slits 36. Extending from the last mentioned fold line 30 is lid panel 27 of the same size as bottom panel 40 with fold lines 30 on each of its unattached sides forming a pair of side flaps 27A and a front flap 28. Side flaps 27A include tapered ends D and E to allow for interference-free insertion into box 25 when closing lid panel 27. It is to be noted that the depth of flaps 27A is equal to the height of sides 26 to provide structural rigidity when fully closed. Crease lines 30 and 31 may optionally include perforations or indentations along the central portion thereof to facilitate folding there along during assembly.

By way of review, it is pointed out that the present invention provides a convenient, sturdy pastry box with integral handles, thus eliminating the need for time consuming string tying and untying. The box is shipped and stored in blank form and readily assembled at the point of use into a sturdy box for many different articles as well. The blank is pre-cut from card stock material of the variety presently used for such purposes. However, the blanks when assembled, provides a rigid container which will protect the items therein due to the reinforced side construction.

While the invention has been described in its preferred embodiment, with particular emphasis on its usefulness for carrying pastry products, it is to be understood that it has many other useful uses and that the words that have been used are words of description rather than words of limitation and that changes may be made within the purview of the appended claims without departing from the full scope or spirit of the invention.

Having thus described my invention, I claim:

1. A pastry box including a pair of convenient carrying handles, said pastry box comprising:

a bottom panel having a first and second pair of opposed side portions extending therefrom;

a lid panel conforming in size to said bottom panel and extending from one of said side portions;

said lid panel including a pair of side flaps and an end flap;

said pair of side flaps on said lid panel extending the full length and depth of an abutting pair of said side portions and providing reinforcement thereto;

said pair of side flaps on said lid panel are each provided with tapered oppposite ends permitting an interference-free closing of said lid panel; and handle means extending from a pair of said opposite side portions for providing said convenient carrying handles.

2. A pastry box including a pair of convenient carrying handles as defined in claim 1 wherein said handle means is formed by diagonal panels extending from one of said first pair of opposite side portions terminating in a vertical extending portion with finger engaging slots therein.

3. A pastry box including a pair of convenient carrying handles as defined in claim 1 wherein a first pair of said opposite side portions includes slits therein and said second pair of opposite side portions include inward turned flap portions with latch means thereon for engaging said slits thus holding said four side portions securely together and form the box enclosure.

4. A one piece box blank having a plurality of cut and fold lines thereon and including an integral handle, said one piece box blank comprising:

a bottom panel portion with a fold line on each side thereof with two pair of opposed sides extending therefrom;

a first pair of said opposed sides including latch receiving means and having further fold lines spaced from a pair of said bottom fold lines outward of said latch receiving means;

handle panel portions extending from said further fold lines and each handle panel portion including a third outboard fold line followed by a finger receiving cut-out portion;

a second pair of said opposed sides including fold lines in alignment with said first mentioned fold lines and having a pair of latch flaps thereon formed by an extension of said sides with cuts therein to allow folding at each corner of said bottom panel portion; and a lid panel extending from one of said second pair of opposed sides formed by a fourth fold line and including a pair of opposed lid side flaps and a front lid flap whereby said one piece blank can readily be folded along said fold lines and cuts into a box with a carrying handle.

5. A one piece box blank as defined in claim 4 wherein said latch receiving means comprises a pair of spaced slits on said first pair of sides for receiving said latch flaps.

6. A one piece box blank as defined in claim 4 wherein said opposed side flaps of said lid panel include tapered forward and rear ends to allow for interference-free insertion of said side flaps when closing said lid panel.

* * * * *